United States Patent [19]

Andersson

[11] 4,139,048

[45] Feb. 13, 1979

[54] MAGNETIC STIRRER FOR CONTINUOUSLY CASTING METAL

[75] Inventor: Conny Andersson, Viken, Sweden

[73] Assignee: ASEA Aktiebolag, Vasteras, Sweden

[21] Appl. No.: 790,947

[22] Filed: Apr. 26, 1977

[30] Foreign Application Priority Data

May 21, 1976 [SE] Sweden ..... 7605770

[51] Int. Cl.[2] ..... B22D 11/12

[52] U.S. Cl. ..... 164/147; 164/49; 164/250; 164/442

[58] Field of Search ..... 164/49, 147, 441, 442; 425/3; 72/56; 264/22, 24; 193/35 R

[56] References Cited

U.S. PATENT DOCUMENTS 3,882,923 5/1975 Alberny et al. ..... 164/49 X 4,016,926 4/1977 Yamada et al. ..... 164/147

4,030,534 6/1977 Ito et al. ..... 164/147

FOREIGN PATENT DOCUMENTS 19414 11/1972 Japan ..... 164/49

*Primary Examiner*—Richard B. Lazarus

*Assistant Examiner*—Mark Rosenbaum

*Attorney, Agent, or Firm*—Kenyon & Kenyon, Reilly, Carr & Chapin

[57] ABSTRACT

A continuously cast metal strand has its solidified skin supported by a series of closely interspaced pairs of rollers and for stirring at least one magnetic stirrer is positioned outside of some of these rollers with the latter being made of non-magnetic material so they are penetrated by the stirrer's flux to permit magnetic stirring of molten metal within the skin.

1 Claim, 1 Drawing Figure

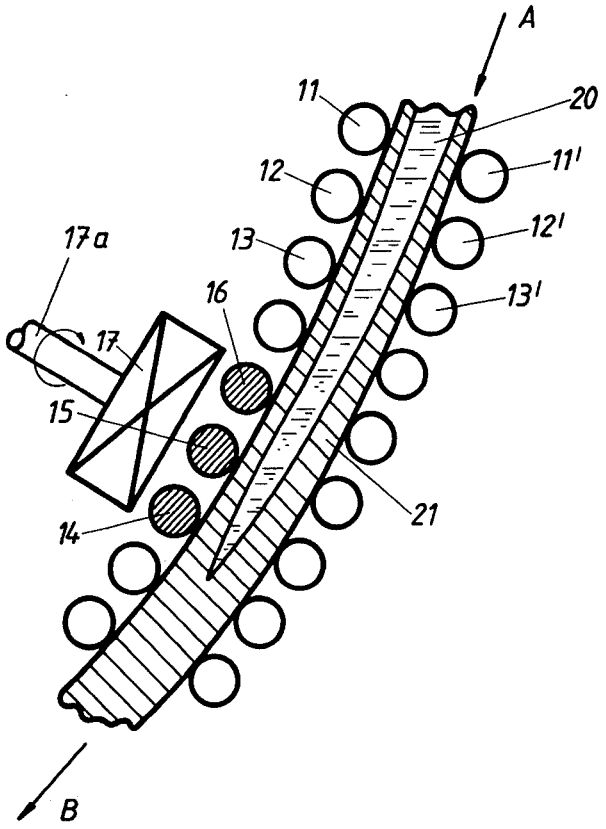
A
11
20
11'
12
12'
17a
13
13'
16
17
15
21
14
B

MAGNETIC STIRRER FOR CONTINUOUSLY CASTING METAL

BACKGROUND OF THE INVENTION

In the continuous casting of steel a cast steel strand continuously leaves the casting mold with a relatively thin skin of solidified steel containing molten steel, the strand traveling through a series of rollers which support the skin on opposite sides of the strand, cooling progressively causing the skin to thicken by solidification of the molten steel until a solid steel strand is obtained.

It is desirable to stir the molten steel within the skin, for example, to prevent the formation of pipe and dendrites.

For such stirring the Alberny et al U.S. Pat. No. 3,882,923 suggests that some of the skin-supporting rollers be made tubular and internally provided with an electrical inductor structure which, when provided with multi-phase AC, forms a traveling magnetic field in the molten steel within the skin, thereby inductively stirring the molten steel. Anyone unfamiliar with the principles of inductively stirring molten metal can be informed via that patent.

The prior art has also suggested the use of nonrotative stationary electric inductive stirrers positioned between the skin-supporting rollers which must then be undesirably widely spaced to provide room for these stirrers. These fixed stirrers operate on the same inductive stirring principles described by the Alberny et al patent.

The above non-rotative type of stirrer has the advantages that its design and construction are simplified and a more rugged and reliable construction is possible, but there is the disadvantage that the rollers which must support the skin of the continuously cast strand, must be widely spaced at the stirrer so that the skin support at those locations is lost. The rotative type of the Alberny et al patent have the advantage that the strand skin is continouously supported by closely interspaced rollers but have the disadvantages of complexity of construction, a lack of the ruggedness of the fixed or non-rotative type, and introduce design complications because the space inside such a stirring roller is limited by the internal diameter of the tubular roller.

SUMMARY OF THE INVENTION

According to the present invention, the series of closely interspaced pairs of rollers for supporting the strand skin during progressive solidification of the liquid metal within this skin, are uninterrupted and the rollers can be closely interspaced. Wherever required for metallurgical reasons, fixed non-rotative electric induction stirrers are positioned on the outsides of the rollers which are interposed between the stirrers and the continuously traveling cast strand, and those interposed rollers are made of non-magnetic material so that the traveling magnetic fields of the stirrers can travel through these interposed rollers, penetrate the skin of the cast strand, and inductively stir the molten metal inside of this strand. The non-magnetic material used may be either a non-magnetic metal or a suitable ceramic material, the only requirement for the material used being that it must be non-magnetic and capable of adequate mechanical strength to support the cast strand and, of course, be capable of retaining its strength at the temperatures, such as 800°C. or more, to which the skin-supporting rollers of a continuous metal casting machine are typically exposed.

The rollers interposed between the fixed or non-rotative stirrers can be of the same diameters and lengths as are all the other rollers throughout the roller series extending from the continuous casting mold of a continuous metal casting machine througout the strand length requiring its skin to be supported.

With the present invention there is no practical limit on the sizes of the magnetic stirrers or their location or the number of the stirrers used throughout the roller series. The design and construction of fixed stirrers are free from the complications inherent to the roller type.

Because of the disadvantages of the roller type of inductive stirrer and of the fixed type, when used by widely interspacing the rollers and positioning the stirrer between the spread rollers, it has heretofore been a practical impossibility to use the number of stirrers positioned along the strand length than might otherwise be desirable. This has lead to much discussion concerning which stage of the solidification process inductor stirring of the interior molten metal should be started and how often inductive stirring should be used. The stirring of the molten metal in the traveling strand skin is, of course, to prevent the occurrence of dendritic structures in the solidified casting and also to prevent the formation of pipe. Prior art has been forced to restrict the use of inductive stirring by the disadvantages previously noted.

With the present invention the stirring may be started at any time and repeated as often as desired throughout the length of the roller series through which the cast strand travels during its solidification process. The skin is continuously supported by closely interspaced rollers throughout the solidification zone while the inductive stirrers may be used to any extent desired, at any location desired, and without much trouble may be moved from one position to the other.

Although the flux path is lengthened by the use of this invention, this can be compensated for by the design of the rugged fixed magnetic induction stirring construction and, in fact, has the advantage that the traveling flux field is spread so that more effective stirring is possible.

Normally the traveling flux field of the prior art stirrers extends at right angles to the traveling direction of the continuously cast metal strand, and this practice can be followed in the case of the present invention. However, the traveling direction of the flux field is unlimited because the stationary stirrers of the present invention, located on the outsides of all the rollers, can be made to rotate in the plane of the strand if desired, providing the number of interposed non-magnetic rollers are used in sufficient number to provide a large enough magnetically permeable "window" to accomodate such rotation.

Because the stirrers of the present invention do not need to use rotative bearings, electrical connections permitting rotation and the like, the stirrers can be made more effectively water-proof than in the case of the roller type, which may be desirable in case the skin supporting rollers are subjected to cool water sprays.

DETAILED DESCRIPTION OF THE DRAWING

The accompanying drawing schematically illustrates the foregoing principles of this invention, the single FIGURE showing the strand from the casting mold of a continuous casting machine, traveling in a curved path downwardly and near the end of the strand's complete solidification phase.

DETAILED DESCRIPTION OF THE INVENTION

Having reference to the above, the series of roller pairs 11-11', 12-12', 13-13', and shown on downwardly, are closely interspaced to support the strand shown coming downwardly at the arrow A and continuing onwardly at the arrow B. Three of the rollers 14, 15 and 16 are made of non-magnetic material to provide an electromagnetic window, these rollers being of the same diameter as the others, the others all being the conventional rollers for supporting the skin of the cast and solidifying strand coming from the casting mold of a continuous metal casting machine.

The metal of the strand is conventionally magnetic, being normally steel, which is one of the major products of continuous metal casting machines. The descending solidifying strand is shown with its molten steel interior 20 confined by the skin 21 initially formed quite thin in the casting mold and progressively solidifying during its downward travel from the mold, the series of roller pairs supporting this skin to prevent a breakout of the steel molten metal held within the skin.

The stationary electric inductive stirrer is shown at 17 free from contact with the non-magnetic rollers 14, 15 and 16, but adjacent to these rollers. This stirrer 17 may be constructed in the usual manner and supplied with multi-phase AC to provide the traveling magnetic field which traverses the strand at right angles and inductively stirs the molten metal in the strand. The stirrer may be designed and constructed in the same manner as in the case of the prior art stationary inductive stirrers which were located in a space provided by the removal of the rollers 14, 15 and 16, leaving the strand unsupported throughout that area.

Although only one of the stirrers 17 is illustrated it is to be understood that corresponding stirrers may be positioned wherever desired along the length of the solidifying strand, in any number desired and on either side of the strand, the interposed supporting rollers corresponding to 14, 15 and 16 being made of non-magnetic material.

The stirrer 17, assuming it is desired as usual to provide a traveling magnetic field right angularly traversing the strand, can be mounted to rotate in a plane parallel to that of the strand, as is schematically illustrated by the stirrer mounting shaft 17*a* arranged to permit such rotation of the stirrer. In this way the traveling field can be induced in the molten metal in the strand in any desired direction. Assuming the stirrer is made waterproof, as previously suggested, any rotative mounting used for the stirrer need not penetrate the stirrer casing and it may be journaled by rugged external bearings desired to meet the service conditions encountered by continuous casting operations.

The non-magnetic rollers may be made of austenitic steel, such as an austenitic stainless steel, and they may be otherwise designed just as are the usual other supporting rollers. Suitable ceramic materials may also be used. The other rollers are normally magnetic, being usually made of steel.

What is claimed is:

1. Continuous metal casting equipment comprising skin support rollers for supporting the opposite sides of a continuously traveling magnetic metal strand forming a solidified skin internally containing molten metal, said support rollers forming on each of said sides an uninterrupted series of substantially uniform and closely interspaced support rollers, the insides of said series contacting said skin so as to substantially continuously support the skin against breaking and releasing its contained molten metal, and a stationary inductive stirrer for inductively stirring the molten metal inside of said skin, said stirrer being positioned on the outside of one of said series with some of the rollers of that series interposed between the stirrer and said strand, and made of non-magnetic material so as to form a magnetically permeable window for the stirrer, the balance of said rollers being made of magnetic metal.

* * * * *